US007094044B2

(12) United States Patent
Strueh

(10) Patent No.: US 7,094,044 B2
(45) Date of Patent: Aug. 22, 2006

(54) VANE PUMP HAVING A PRESSURE COMPENSATING VALVE

(75) Inventor: Timothy Carl Strueh, Linden, IN (US)

(73) Assignee: TRW Automotive U.S. LLC, Livonia, MI (US)

( * ) Notice: Subject to any disclaimer, the term of this patent is extended or adjusted under 35 U.S.C. 154(b) by 264 days.

(21) Appl. No.: 10/495,705

(22) PCT Filed: Nov. 13, 2002

(86) PCT No.: PCT/US02/37314

§ 371 (c)(1),
(2), (4) Date: May 14, 2004

(87) PCT Pub. No.: WO03/044368

PCT Pub. Date: May 30, 2003

(65) Prior Publication Data

US 2005/0008508 A1 Jan. 13, 2005

(51) Int. Cl.
*F04C 2/344* (2006.01)

(52) U.S. Cl. ..... 418/82; 418/268

(58) Field of Classification Search ..... 418/82, 418/268

See application file for complete search history.

(56) References Cited

U.S. PATENT DOCUMENTS 3,253,548 A 5/1966 Zeigler et al.
3,828,569 A 8/1974 Weisgerber
4,604,041 A 8/1986 Hertell et al.
4,936,761 A 6/1990 Hasegaki et al.
4,986,741 A * 1/1991 Nakajima et al. ..... 418/268
6,015,278 A 1/2000 Key et al.

FOREIGN PATENT DOCUMENTS

DE 29 07 058 A1 9/1979
DE 41 10 392 A1 10/1991
DE 195 06 532 A1 8/1995
DE 195 29 807 A1 2/1997

* cited by examiner

*Primary Examiner*—Michael Koczo, Jr.
(74) *Attorney, Agent, or Firm*—Tarolli, Sundheim, Covell & Tummino LLP

(57) ABSTRACT

An apparatus (10) comprises a pump (12) and a pressure compensating valve (94). The pump (12) includes a member (22) having a surface (24) defining a pumping chamber. A rotatable rotor (30) is located in the pumping chamber. The rotor (30) has circumferentially spaced vane-like members (42) defining pumping pockets (48) that expand and contract during rotation of the rotor (30). The pump (12) has a fluid circuit (72) providing fluid pressure for biasing the vane-like members (42) of the rotor (30) radially toward the surface (24). The pressure compensating valve (94) controls fluid flow through an outlet (16) and also controls the pressure in the fluid circuit (72). The pressure compensating valve (94) has an initial condition blocking fluid flow through the outlet (16) at pump start-up to provide fluid pressure in the fluid circuit (72) to bias the vane-like members (42) of the rotor (30) radially toward the surface (24).

11 Claims, 4 Drawing Sheets

VANE PUMP HAVING A PRESSURE COMPENSATING VALVE

TECHNICAL FIELD

The present invention relates to a pressure compensating valve for a pump. More particularly, the present invention relates to a pressure compensating valve for a pump for supplying steering fluid to a power steering mechanism of a vehicle.

BACKGROUND OF THE INVENTION

Vane pumps are used for supplying fluid to a hydraulic motor of a power steering mechanism. The vane pump includes a rotor that is rotatable within a cam ring. The rotor of the pump includes a plurality of circumferentially spaced grooves. A vane is carried in each groove. The vanes extend radially outwardly from the grooves of the rotor toward a surface of the cam ring. Pumping pockets are formed between adjacent vanes. The pumping pockets receive fluid from an inlet port and deliver fluid to a discharge port of the pump.

When the pump is at rest, i.e., the rotor is stationary relative to the cam ring, the vanes may move radially inwardly into the grooves of the rotor and away from the surface of the cam ring. When the rotor begins to rotate and one or more of the vanes of the pump are in a radially inward position, the amount of fluid discharged from the pump is low relative to pump operation with all of the vanes extended radially outwardly toward the surface of the cam ring.

A hydraulic power steering mechanism requires a minimum flow rate of fluid from the pump for proper operation. When the flow rate is below the minimum value, the power steering mechanism may be non-responsive to inputs requesting power steering assistance.

A vane pump generally cannot provide a fluid flow sufficient to reach the minimum flow rate until all of the vanes of the pump move radially outwardly toward the cam ring surface. Thus, the power steering mechanism may be not sufficiently responsive from pump start-up until all of the vanes are positioned radially outward toward the cam surface.

Upon start-up of the vehicle, the vane pump is rotated from a rest position to an angular velocity that is equal to the engine idle speed. For example, some commercial truck engines idle at a speed of between 600 and 750 rpm.

In some vane pumps used for supplying fluid to a power steering mechanism, all of the vanes may not move radially outward toward the cam ring until the pump reaches an angular velocity that is greater than the vehicle engine's idle speed. For example, in some pumps all of the vanes do not extend radially outwardly toward the cam ring until the rotor of the pump rotates at approximately 900 rpm. Thus, the power steering mechanism in the vehicle having one of these pumps may not be sufficiently responsive until the engine speed is increased to about 900 rpm. It is desirable to increase the responsiveness of the hydraulic power steering mechanism and to provide a pump in which all of the vanes move radially outward toward the cam ring at a pump speed that is well below the vehicle engine's idle speed.

SUMMARY OF THE INVENTION

The present invention relates to an apparatus comprising a pump and a pressure compensating valve. The pump has an outlet for supplying steering fluid to a power steering mechanism. The pump includes a member (cam ring) having a surface defining a pumping chamber. A rotatable rotor is located in the pumping chamber. The rotor has circumferentially spaced vane-like members defining pumping pockets that expand and contract during rotation of the rotor. The pump has a fluid circuit providing fluid pressure for biasing the vane-like members of the rotor radially toward the surface defining the pumping chamber. The pressure compensating valve controls fluid flow through the outlet and also controls the pressure in the fluid circuit. The pressure compensating valve has an initial condition blocking fluid flow through the outlet at pump start-up to provide fluid pressure in the fluid circuit to bias the vane-like members of the rotor radially toward the surface defining the pumping chamber.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
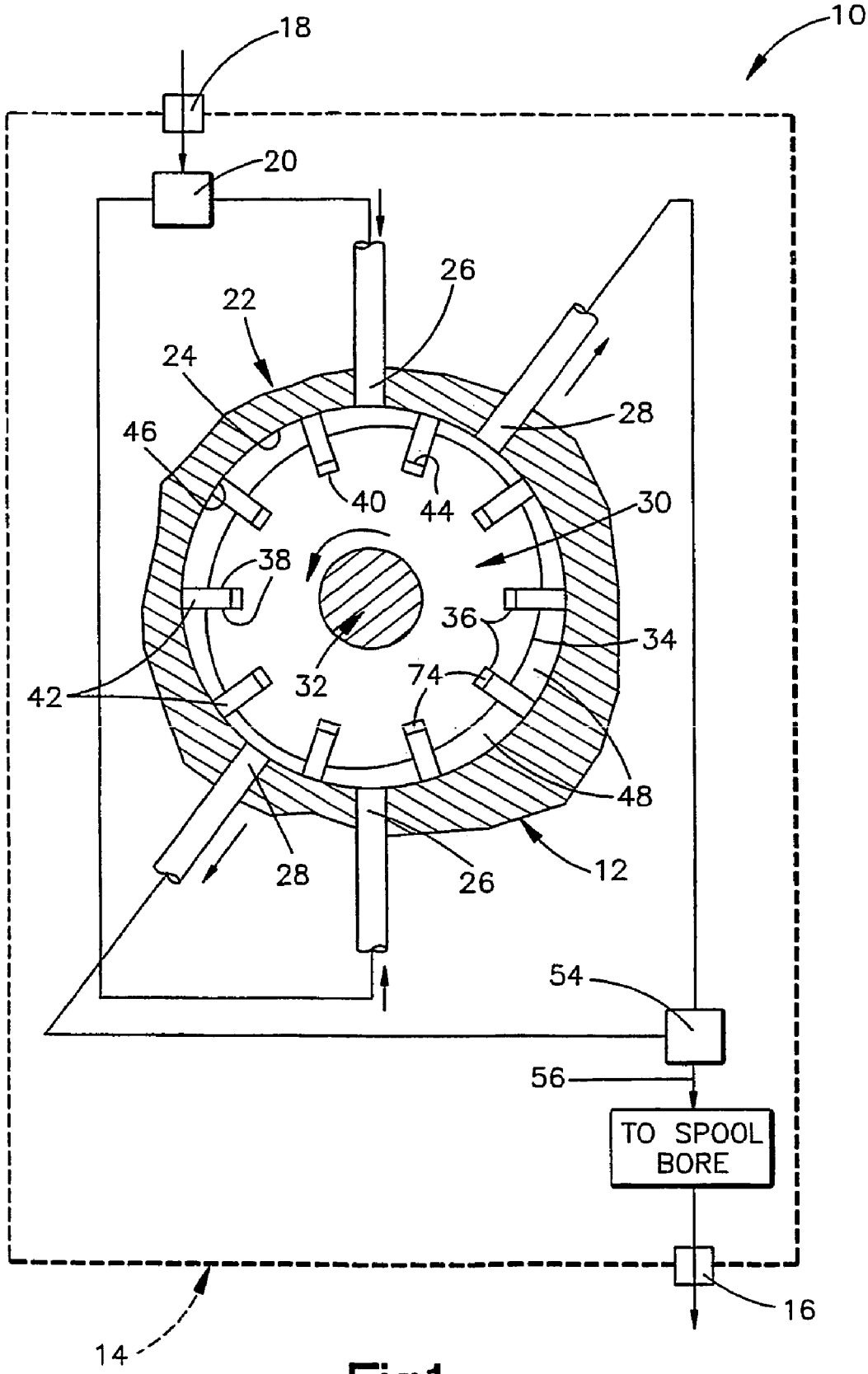
FIG. 1 is a schematic illustration of an apparatus constructed in accordance with the present invention.

FIG. 1 schematically illustrates an apparatus 10 constructed in accordance with the present invention. The apparatus 10 may be used for supplying hydraulic fluid to a hydraulic motor (not shown), via a control valve (not shown), of a vehicle power steering mechanism.

The apparatus 10 includes a housing 14, shown schematically in FIG. 1. The housing 14 includes a single outlet 16 for discharging hydraulic fluid from the apparatus 10 toward the power steering mechanism. The housing 14 also includes a single return port or inlet 18 for returning hydraulic fluid from the power steering mechanism. A fluid reservoir 20, shown schematically in FIG. 1, is generally located within the housing 14. The fluid reservoir 20 supplies fluid to a vane pump 12 of the apparatus 10 and receives fluid returned to the apparatus from the power steering mechanism.

The vane pump 12 of the apparatus 10 illustrated in FIG. 1 is a balanced rotary vane pump. Vane pumps other than balanced rotary vane pump may be utilized with the present invention. The vane pump 12 includes a cam ring 22. The cam ring 22 is fixed relative to the housing 14 and includes a generally elliptical inner surface 24. Two inlet ports 26 extend through the cam ring 22 and terminate at the inner surface 24 of the cam ring 22. Two discharge ports 28 also extend through the cam ring 22 and terminate at the inner surface 24 of the cam ring. Alternatively, the inlet ports 26 and the discharge ports 28 may be located in a plate mounted adjacent cam ring 22 of the pump, such as the plate 52 shown in FIG. 3.

A rotor 30 is mounted within the cam ring 22 and is rotatable relative to the cam ring 22. Specifically, the rotor 30 is connected to an input shaft 32. The engine (not shown) of the vehicle (not shown) drives the input shaft 32. Thus, as the engine rate increases, the rate of rotation of the input shaft 32 increases and thus, the rotation rate of the rotor 30 increases.

The rotor 30 has a cylindrical outer surface 34 that is coaxial with the input shaft 32. A plurality of slots or grooves 36 extends into the outer surface 34 of the rotor 30. FIG. 1 shows ten grooves 36, for example, extending into the outer surface 34 of the rotor 30. The number of grooves 36 may be other than ten. The grooves 36 are circumferentially spaced about the outer surface 34 of the rotor 30 and extend along a length of the rotor. Each groove 36 includes a pair of parallel extending side walls 38 and terminates at an inner wall 40. An imaginary circle (not shown) connecting the inner walls 40 of the grooves 36 is coaxial with the outer surface 34 of the rotor 30 and the input shaft 32.

Each groove 36 in the rotor 30 carries a vane 42. Each vane 42 is a generally flat, elongated plate. Each vane 42 is movable relative to the rotor 30 and is sized to slidingly engaging the side walls 38 of the associated groove 36.

The vanes 42 move radially inwardly, i.e., contract, and radially outwardly, i.e., extend, in the associated grooves 36. An inner surface 44 of each vane 42 remains within the associated groove 36, i.e., radially inward on the outer surface 34 of the rotor 30, during radial movement of the vane 42. During normal operation of the vane pump 12, an outer surface 46 of each vane 42 contacts the inner surface 24 of the cam ring 22 and slides along the inner surface of the cam ring during rotation of the rotor 30. Contact refers to the outer surface 46 of each vane 42 being in close proximity to the inner surface 24 of the cam ring 22 and encompasses a fluid film separating the surfaces.

The vane pump 12 includes a plurality of pumping pockets 48. Each pumping pocket 48 is defined between adjacent vanes 42 and between the outer surface 34 of the rotor 30 and the inner surface 24 of the cam ring 22. First and second plates 50 and 52, respectively, as will be described in detail below with reference to FIGS. 2 and 3, form two additional surfaces that define the pumping pockets 48. During rotation of the rotor 30 within the cam ring 22, the volume of the pumping pockets 48 varies. As the vanes 42 associated with a pumping pocket 48 extend from the rotor 30, the volume of the pumping pocket 48 increases, i.e., the pumping pocket 48 expands. Contrarily, as the vanes 42 of the pumping pocket 48 contract, the volume of the pumping pocket 48 decreases, i.e., the pumping pocket 48 contracts.

When the input shaft 32 of the vane pump 12 is rotated, the rotor 30 is rotated relative to the cam ring 22. During normal operation of the vane pump 12, fluid from the reservoir 20 flows through an inlet port 26 and into a respective pumping pocket 48 of the pump. The fluid flows into the respective pumping pocket 48 during expansion of the respective pumping pocket. As the rotor 30 continues to rotate, the respective pumping pocket 48 begins to contract. When positioned adjacent a discharge port 28, contraction of the respective pumping pocket 48 results in the fluid being discharged through the discharge port 28.

The vane pump 12 illustrated in FIG. 1 includes two inlet ports 26 and two discharge ports 28. Thus, during a single rotation of the rotor 30, a respective pumping pocket 48 displaces two volumes of fluid from an inlet port 26 to a discharge port 28. As shown schematically in FIG. 1, the two discharge ports 28 connect to a discharge fluid chamber 54. A single fluid passage 56 (FIG. 4) extends downstream of the discharge fluid chamber 54 for carrying fluid toward the outlet 16 of the apparatus 10.

The operation of the vane pump 12 described above and referred to as the "normal operation" occurs when all of the vanes 42 of the vane pump 12 are positioned with their outer surfaces 46 in contact with the inner surface 24 of the cam ring 22. However, when the vane pump 12 is at rest, i.e., the input shaft 32 is not rotating the rotor 30, some of the vanes 42 of the vane pump 12 may move to a position in which their outer surfaces 46 do not contact the inner surface 24 of the cam ring 22. For example, assuming that the vane pump 12 of FIG. 1 is mounted in a vehicle so that the ground is located at the bottom of FIG. 1, gravity may cause the vanes 42 located on an upper side, as viewed in FIG. 1, to slide downwardly into an associated groove 36 and away from the inner surface 24 of the cam ring 22. In addition to gravity, vehicle vibrations and other factors may cause various vanes 42 to move away from the inner surface 24 of the cam ring 22.

When one or more of the vanes 42 of the rotor 30 have moved away from the inner surface 24 of the cam ring 22, the fluid within one pumping pocket 48 in the pump 12 may flow over a vane 42, i.e., between the outer surface 46 of the vane 42 and an inner surface 24 of the cam ring 22, and into an adjacent pumping pocket 48. Specifically, as the rotor 30 rotates and a pumping pocket 48 begins to contract, only a small amount of fluid may be forced out of the discharge port 28. As a result, the flow rate of fluid discharged through the discharge ports 28 of the vane pump 12 at a particular pump speed is relatively low when compared to the flow rate at that pump speed when all of the vanes 42 are contacting the inner surface 24 of the cam ring 22.

As the rotor 30 of the pump 12 begins to rotate from a rest position, i.e., start-up of the pump, centrifugal force begins to act on the vanes 42 to force the vanes into contact with the inner surface 24 of the cam ring 22. The centrifugal force generally is insufficient to force all of the vanes 42 into contact with the cam ring 22 at a pump speed associated with the vehicle engine's idle speed. Since the centrifugal force is generally insufficient to move all of the vanes 42 into contact the inner surface 24 of the cam ring 22, other provisions for forcing the vanes against the cam ring 22 are provided, as will be described below.

Figure 2:
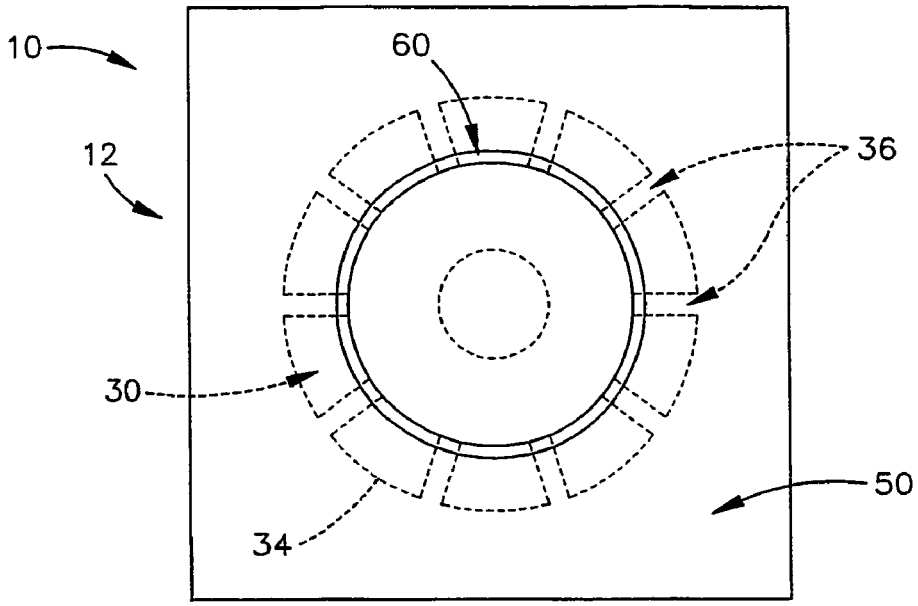
FIG. 2 is a schematic illustration of a first plate of a vane pump of the apparatus of FIG. 1.
Figure 3:
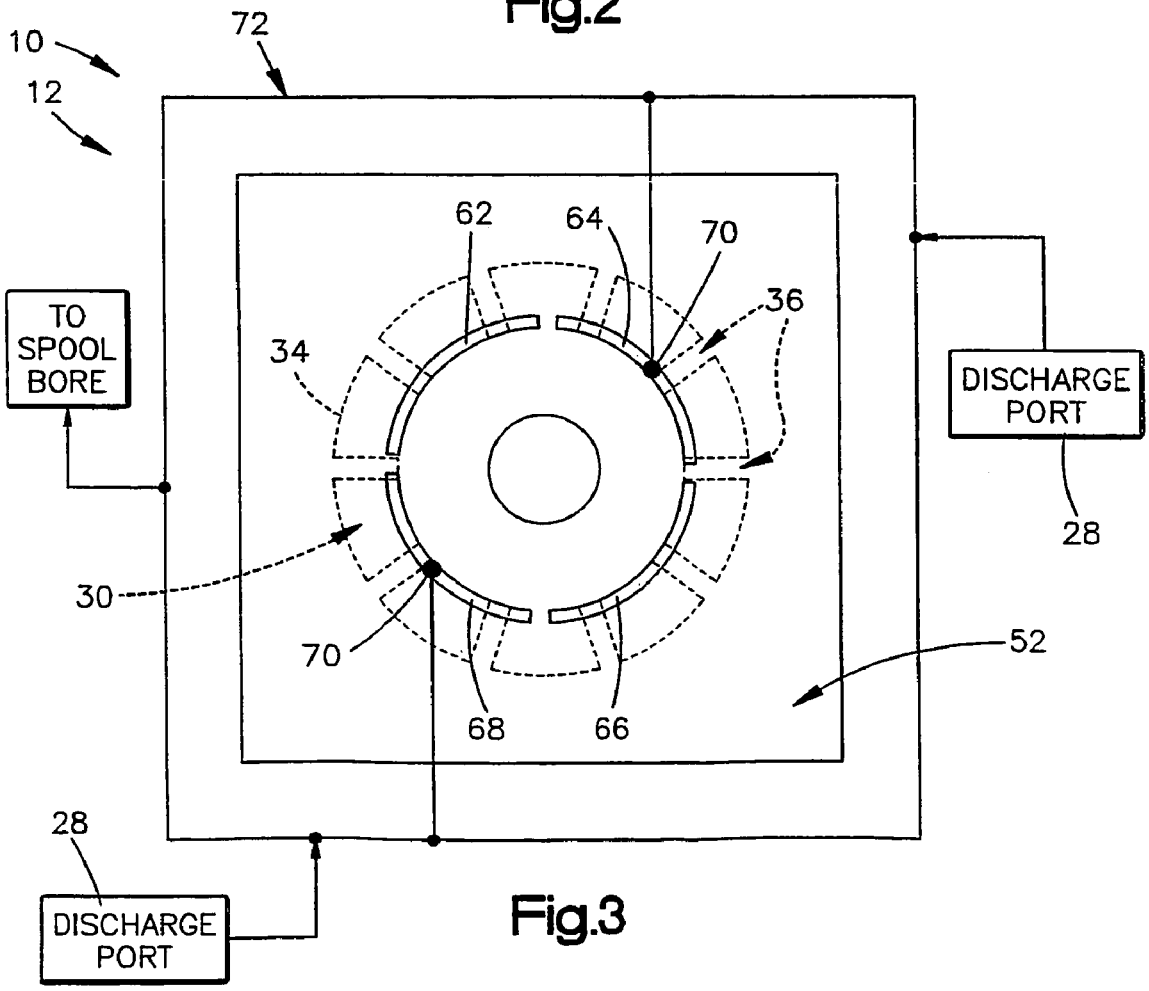
FIG. 3 is a schematic illustration of a second plate of the vane pump of the apparatus of FIG. 1.

FIG. 2 illustrates a first plate 50 of the vane pump 12. The first plate 50 is located adjacent a first side of the rotor 30. FIG. 3 illustrates a second plate 52 of the vane pump 12. The second plate 52 is located adjacent a second side of the rotor 30, opposite the first end. As shown in FIG. 3, an aperture 58 extends through the second plate 52 for receiving the input shaft 32. A seal (not shown) may be located in the aperture 58 for preventing fluid leakage between a surface defining the aperture and the input shaft 32.

With reference to FIG. 2, an annular groove 60 is formed in a surface of the first plate 50. The annular groove 60 is coaxial with the input shaft 32 and has an inner diameter and an outer diameter. In an assembled vane pump 12, the inner diameter of the annular groove 60 aligns with the inner walls 40 of the grooves 36 of the rotor 30. The rotor 30 is shown by dotted lines in FIG. 2. The annular groove 60 acts as a fluid conduit, as will be described below.

With reference to FIG. 3, four arcuate grooves, indicated at 62, 64, 66, and 68, are formed in a surface of the second plate 52. The arcuate grooves 62–68 have an inner diameter and an outer diameter. In an assembled vane pump 12, the inner diameter of each arcuate groove 62–68 aligns with the inner wall 40 of the grooves 36 of the rotor 30. The rotor 30 is shown by dotted lines in FIG. 3. Each of diametrically opposed arcuate grooves 64 and 68 includes a fluid port, shown schematically at 70. As is also shown schematically in FIG. 3, arcuate grooves 64 and 68 form a portion of a fluid circuit, indicated generally at 72.

With reference again to FIG. 1, a fluid pocket 74 is formed in each groove 36 of the rotor 30. The inner wall 40 and side walls 38 of the groove 36 and the inner surface 40 of the associated vane 42 define the fluid pocket 74. As the vane 42 slides radially inwardly and outwardly within the groove 36 of the rotor 30, the volume of the respective fluid pocket 74 decreases, i.e., contracts, and increases, i.e., expands.

The annular groove 60 on the first plate 50 is in fluid communication with each fluid pocket 74. As one vane 42 on the rotor 30 moves radially outward, another vane 42 moves radially inward. The radially inward movement of the vane 42 forces fluid out of the contracting fluid pocket 74. The fluid flows into the annular groove 60 of the first plate 50. Simultaneously, fluid from the annular groove 60 flows into an expanding fluid pocket 74 moving a vane 42 radially outward.

Additionally, each fluid pocket 74 of the rotor 30 is in fluid communication with at least one arcuate groove 62–68 of the second plate 52. Arcuate grooves 62 and 66 act as fluid conduits similar to the function of annular groove 60. Arcuate grooves 64 and 68 form portions of the fluid circuit 72 and communicate fluid to the fluid pockets 74 for forcing the vanes 42 radially outwardly toward the cam ring 22.

As the rotor 30 begins to rotate from a rest position, fluid is discharged into the discharge ports 28 of the vane pump 12, even when one or more of the vanes 42 have moved radially inwardly out of contact with the cam ring 22. This discharge fluid increases the fluid pressure within the fluid circuit 72. As a result, the fluid pressure in arcuate grooves 64 and 68 of the second plate 52 increases. This increased fluid pressure in arcuate grooves 64 and 68 is communicated into the fluid pockets 74 of the rotor 30 adjacent arcuate grooves 64 and 68. The fluid pressure communicated by arcuate grooves 64 and 68 acts on the inner surfaces 40 of the vanes 42 to force the vanes radially outwardly toward the inner surface 24 of the cam ring 22. Arcuate grooves 64 and 68 are located in positions adjacent portions of the cam ring where the vanes 42 move radially outwardly or extend. When all of the vanes 42 are positioned radially outward toward the inner surface 24 of the cam ring 22, normal operation of the vane pump 12, as described above, begins.

With reference again to FIG. 1, the fluid discharged into the discharge ports 28 enters the discharge fluid chamber 54. Fluid passage 56 extends downstream of the discharge fluid chamber 54 for communicating fluid toward the outlet 16 of the apparatus 10. The discharge fluid chamber 54 and fluid passage 56 also form portions of the fluid circuit 72.

Figure 4:
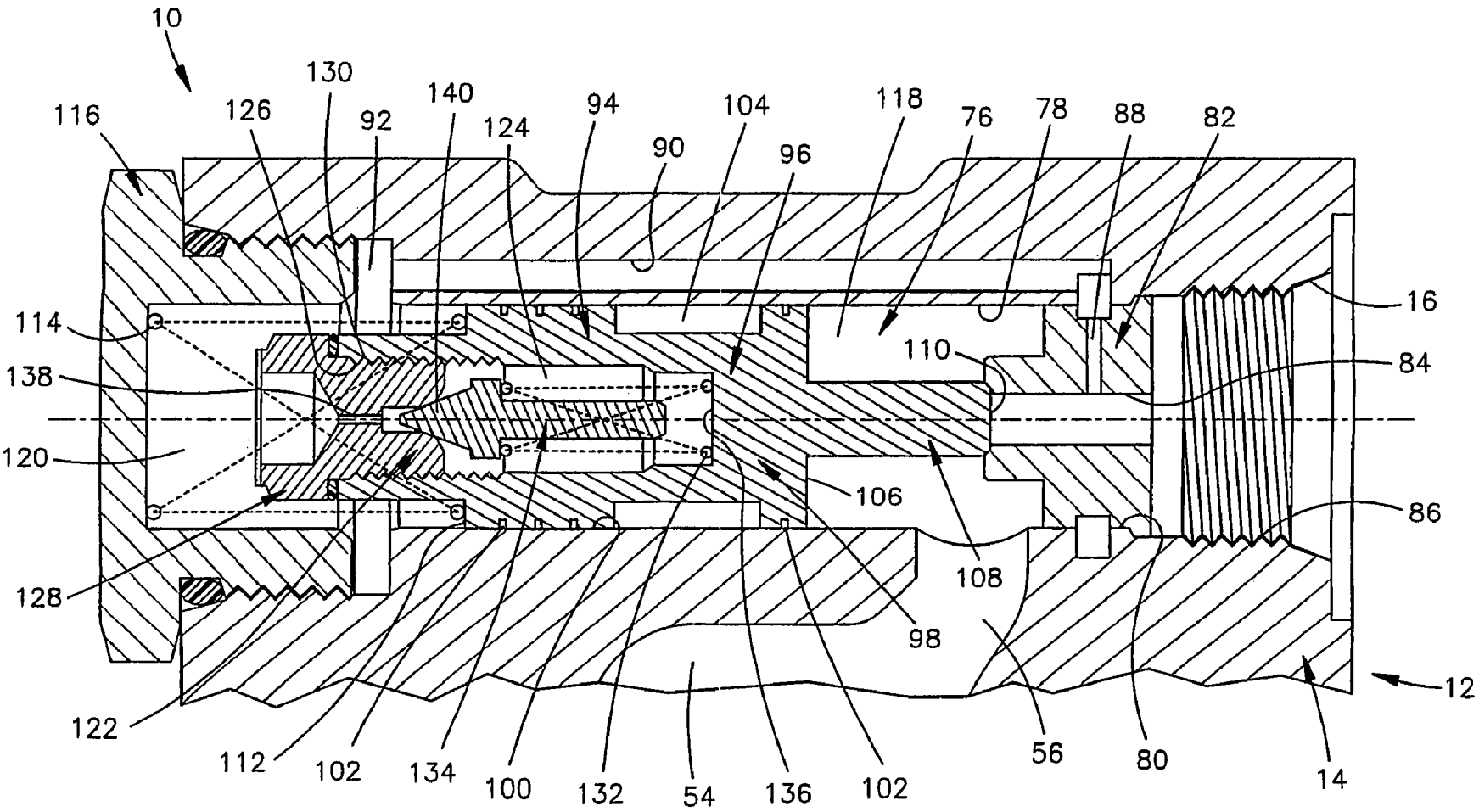
FIG. 4 is a schematic illustration of a portion of the apparatus constructed in accordance with the present invention.

As shown in FIG. 4, fluid passage 56 terminates in a spool bore 76 within the housing 14 of the apparatus 10. The spool bore 76 has a generally cylindrical inner surface 78 and includes a discharge orifice 80 that connects with the outlet 16 of the apparatus 10.

An orifice plug 82 is located in the discharge orifice 80 of the spool bore 76. Preferably, the orifice plug is press fit into the discharge orifice 80. The orifice plug 82 includes a flow control orifice 84 for communicating fluid from the spool bore 76 to the outlet 16. The outlet 16 of the apparatus 10 is shown in FIG. 4 as including internal threads 86 for receiving a discharge conduit (not shown).

A radially extending passage 88 in the orifice plug 82 connects the flow control orifice 84 to an axially extending passage 90 formed in the housing 14 adjacent the spool bore 76. Passage 90 connects to a pressure chamber 92. Pressure chamber 92 connects to the spool bore 76 near an end of the spool bore 76 opposite the outlet 16.

A pressure compensating valve 94 is disposed in the spool bore 76. The pressure compensating valve 94 includes a valve spool 96 that is movable axially within the spool bore 76. The valve spool 96 moves as a function of fluid pressure, as will be described below.

The valve spool 96 includes a generally cylindrical main body portion 98. A cylindrical outer surface 100 of the main body portion 98 of the valve spool 96 includes a number of annular grooves 102, four of which are shown in FIG. 4. Each annular groove 102 is a balancing or anti-stiction groove. The annular grooves 102 act as a labyrinth seal, balance the pressure around the valve spool 96 to center the valve spool in the spool bore 76, and prevent the valve spool from sticking to a portion of the spool bore. The outer surface 100 of the main body portion 98 of the valve spool 96 also includes an annular bypass groove 104.

The main body portion 98 of the valve spool 96 also includes a first working surface 106. The first working surface 106 is generally annular. An elongated member 108 extends axially outwardly from the first working surface 106 of the main body portion 98 of the valve spool 96. The elongated member 108 is generally cylindrical and has a diameter that is approximately one-third of the diameter of the main body portion 98 of the valve spool 96. The elongated member 108 terminates opposite the main body portion 98 of the valve spool 96 at an end wall 110.

The main body portion 98 of the valve spool 96 also includes a second working surface 112 opposite the first working surface 106. A spring 114 acts between a plug member 116 and the second working surface 112 of the valve spool 96 to bias the valve spool 96 rightward as viewed in FIG. 4.

When placed in the spool bore 76, the valve spool 96 defines first and second variable volume fluid chambers 118 and 120, respectively, in the spool bore. The first fluid chamber 118 is defined between the first working surface 106 of the valve spool 96 and the orifice plug 82. The second fluid chamber 120 is defined between the second working surface 112 of the valve spool 96 and plug member 116. The second fluid chamber 120 receives fluid from pressure chamber 92. Since the second fluid chamber 120 is in fluid communication with the outlet 16 of the apparatus 10, fluid pressure in the second fluid chamber 120 is generally equal to the fluid pressure at the outlet.

When biased rightward under the force of the spring 114, the end wall 110 of the elongated member 108 covers the flow control orifice 84 of the orifice plug 82. Thus, the elongated member 108 prevents fluid flow from the first fluid chamber 118 into the flow control orifice 84 and toward the outlet 16 of the apparatus 10. Since the elongated member 108 prevents fluid flow through the flow control orifice 84, fluid pressure in the fluid circuit 72 increases during the initial or start-up rotation of the rotor 30 of the pump 12.

When the fluid pressure in the first fluid chamber 118, and thus fluid circuit 72, exceeds the combined influence of the fluid pressure in the second fluid chamber 120 and the spring 114, the valve spool 96 moves leftward, as viewed in FIG. 4. The movement of the valve spool 96 within the spool bore 76 is related to a pressure differential between first fluid chamber 118 and the combined influence of the fluid pressure in the second fluid chamber 120 and the spring 114. As the valve spool 96 moves leftward, the end wall 110 of the elongated member 108 of the valve spool 96 moves away from the orifice plug 82 and opens fluid flow into the flow control orifice 84. As the fluid pressure in the first fluid chamber 118 continues to increase, the valve spool 96 continues to move leftward. Contrarily, if the fluid pressure in the first fluid chamber 118 decreases, the combined influence of the fluid pressure in the second fluid chamber 120 and the spring 114 will move the valve spool 96 rightward.

When the pressure within the first fluid chamber 118 increases to a predetermined level, the valve spool 96 of the pressure compensating valve 94 moves leftward a distance sufficient to connect the first fluid chamber 118 with a bypass passage (not shown). Fluid flowing into the bypass passage is conducted away from the outlet 16 of the apparatus 10 and may be conducted to the reservoir 20 of the vane pump 12.

With reference again to FIG. 4, the pressure compensating valve 94 also includes a pressure relief valve 122. A pocket 124 extends into the main body portion 98 of the valve spool 96 from the second working surface 112. Internal threads 126 are formed in the pocket 124 near an opening into the pocket. A radially extending passage (not shown) connects the pocket 124 to the annular bypass groove 104 for communicating fluid in the pocket to the bypass passage.

The pressure relief valve 122 includes an orifice plate 128 having external threads 130, a spring 132, and a movable actuator 134. The spring 132 biases the actuator 134 away from an inner wall 136 of the pocket 124. The orifice plate 128 is screwed into the pocket 124 in the valve spool 96. An orifice 138 extending through the orifice plate 128 receives a nose portion 140 of the actuator 134.

Fluid within the second fluid chamber 120 flows through the orifice 138 of the orifice plate 128 of the pressure relief valve 122 and acts on the nose portion 140 of the actuator 134. The nose portion 140 of the actuator 134 prevents fluid flow from the orifice 138 of the orifice plate 128 into the pocket 124 when the biasing pressure of the spring 132 is greater than a fluid pressure in second fluid chamber 120. When the fluid pressure in the second fluid chamber 120 increases above the biasing pressure of the spring 132, the actuator 134 is moved rightward, as viewed in FIG. 4, and fluid flows into the pocket 124. Fluid flowing into the pocket 124 passes through the radial passage (not shown), into the annular bypass groove 104, and then into the bypass passage (not shown).

When fluid within the first fluid chamber 118 is prevented from flowing into the flow control orifice 84, fluid pressure in the first fluid chamber increases. As a result, fluid pressure in fluid circuit 79 increases.

As stated above, arcuate grooves 64 and 68 in the second plate 52 of the vane pump 12 form a portion of the fluid circuit 72. As a result, fluid pressure in arcuate grooves 64 and 68 increases as fluid pressure in fluid circuit 72 increases. The fluid in the arcuate grooves 64 and 68 is communicated into the fluid pockets 74 of the rotor 30 and acts on the inner surfaces 44 of the vanes 42 to force the vanes radially outwardly toward the inner surface 24 of the cam ring 22. By increasing the fluid pressure in fluid circuit 72, the fluid pressure in the fluid pockets 74 of the rotor 30 increases. As a result, all of the vanes 42 of the pump 12 are forced to extend radially outward and contact the inner surface 24 of the cam ring 22 at a lower vane pump speed.

Figure 5:
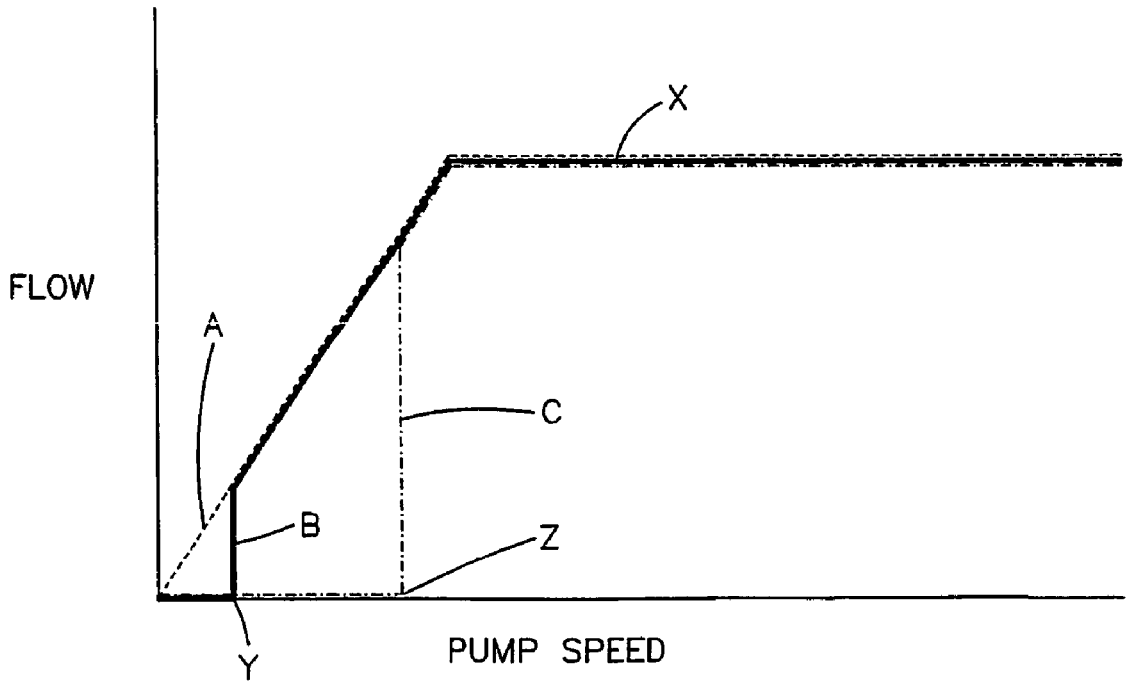
FIG. 5 is a graph comparing an operational characteristic of a pump embodying the present invention with a prior art apparatus and a theoretic apparatus.

FIG. 5 is a graph comparing an operational characteristic of an apparatus constructed in accordance with the present invention with a prior art apparatus and a theoretic apparatus. FIG. 5 illustrates the flow from the outlet of each apparatus in relation to the pump speed of the pump of each apparatus.

The line labeled A in FIG. 5 illustrates the flow from the outlet of a theoretic apparatus as a function of pump speed. In the theoretic apparatus, all of the vanes of the pump are instantaneously extended radially outwardly toward the cam ring as rotation of the rotor of the pump begins. As line A illustrates, the flow from the theoretic apparatus increases proportionally with pump speed until a designed flow rate, indicated at X, is achieved. When the designed flow rate X is achieved, additional flow produced by the pump of the theoretic apparatus is bypassed so that a constant flow is output from the theoretic apparatus. Alternatively, the outlet flow from the theoretic apparatus may be decreased as pump speed increases, as is known in the art.

The line labeled B in FIG. 5 is an apparatus 10 constructed in accordance with the present invention. As illustrated by line B, upon initial rotation of the rotor 30, i.e., start-up of the pump, no flow is discharged from the outlet 16 of the apparatus 10. At the point on line B labeled Y, all of the vanes 42 of the pump 12 have moved radially outwardly toward the cam ring 22 and the fluid pressure in the first fluid chamber 118 is sufficient to move the valve spool 96 to open flow through the flow control orifice 84 to the outlet 16 of the apparatus 10. Once all of the vanes 42 have moved radially outward toward the cam ring 22 and the valve spool 96 opens the flow control orifice 84, the outlet flow from the apparatus 10 follows the flow of the theoretic apparatus illustrated by line A.

The line labeled C in FIG. 5 is an apparatus of the prior art. As illustrated by line C, upon start-up of the pump, very little flow is discharged from the outlet of the prior art apparatus. In fact, the flow rate is so low that it is illustrated as zero in FIG. 5. At the point on line C labeled Z, all of the vanes of the pump of the prior art apparatus have moved radially outwardly toward the cam ring. Once all of the vanes have moved radially outward toward the cam ring, the apparatus of the prior art follows the flow of the theoretic apparatus illustrated by line A.

As is clear from the graph of FIG. 5, the apparatus 10 constructed in accordance with the present invention, more closely emulates the theoretic apparatus. The vanes 42 of the pump 12 of the apparatus 10 move radially outwardly toward the cam ring 22 at a much lower pump speed than the prior art apparatus. The spacing between point Y and point Z in FIG. 5 illustrates this difference. As a result, the apparatus 10 is more likely to provide the flow necessary to operate a power steering mechanism when the vehicle is operating at its engine's idle speed.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

a pump having an outlet for supplying steering fluid to a power steering mechanism, said pump including a member having a surface defining a pumping chamber, a rotatable rotor in said pumping chamber, said rotor having circumferentially spaced vane-like members defining fluid pockets which expand and contract during rotation of said rotor;

said pump having a fluid circuit providing fluid pressure to said fluid pockets for biasing said vane-like members of said rotor radially toward said surface; and a pressure compensating valve for controlling fluid flow through said outlet and for controlling the fluid pressure in said fluid circuit, said pressure compensating valve having an initial condition blocking fluid flow through said outlet at pump start-up to provide fluid pressure in said fluid circuit to bias said vane-like members of said rotor radially toward said surface.

2. Apparatus as defined in claim 1 wherein said pressure compensating valve is actuated from the initial condition to a condition enabling fluid flow from said outlet in response to a pressure increase in said fluid circuit acting on said pressure compensating valve.

3. Apparatus as defined in claim 1 wherein said pump includes a plate located adjacent a side of said rotor, said plate including at least one groove, said at least one groove forming a portion of said fluid circuit and being in fluid communication with a plurality of said fluid pockets.

4. Apparatus as defined in claim 3 wherein said at least one groove is an annular groove that is in fluid communication with all of said fluid pockets.

5. Apparatus as defined in claim 3 wherein said at least one groove includes an arcuate groove having a port through which fluid pressure is communicated.

6. Apparatus as defined in claim 1 wherein said pressure compensating valve includes a valve spool that is movable within a spool bore, a spring urging said valve spool against an orifice for blocking fluid flow through said outlet.

7. Apparatus as defined in claim 6 wherein said valve spool divides said spool bore into first and second fluid chambers, said first fluid chamber forming a portion of said fluid circuit, fluid pressure in said first fluid chamber acting on said valve spool to compress said spring and move said valve spool away from said orifice for enabling fluid flow through said outlet.

8. Apparatus as defined in claim 7 wherein fluid pressure in said second fluid chamber acts on said valve spool to aid said spring in urging said valve spool against said orifice for blocking fluid flow through said outlet.

9. Apparatus as defined in claim 8 wherein said second fluid chamber is in fluid communication with said outlet, downstream of said orifice.

10. Apparatus as defined in claim 8 wherein said valve spool includes a pressure relief valve, said pressure relief valve being actuatable in response to a predetermined pressure to direct fluid away from said second fluid chamber and thereby, reduce fluid pressure in said second fluid chamber.

11. Apparatus as defined in claim 1 wherein said pressure compensating valve includes a valve spool that is movable within a cylindrical spool bore, said valve spool including a cylindrical body portion having a plurality of annular grooves which act to center said valve spool within said spool bore.

* * * * *